US005363728A

United States Patent [19]

Elsner et al.

[11] Patent Number: 5,363,728

[45] Date of Patent: Nov. 15, 1994

[54] TWO ROLL WEB CUTTER AND METHOD

[75] Inventors: Bertram F. Elsner; Robert E. Molison, both of Hanover, Pa.

[73] Assignee: Elsner Engineering Works, Inc., Hanover, Pa.

[21] Appl. No.: 964,728

[22] Filed: Oct. 22, 1992

[51] Int. Cl.[5] ..... B65H 29/54

[52] U.S. Cl. ..... 83/23; 83/116; 83/117; 83/118; 83/119; 83/120; 83/346

[58] Field of Search ..... 83/23, 113, 115, 116, 83/117, 118, 119, 120, 321, 346

[56] References Cited

U.S. PATENT DOCUMENTS

| | | | |
|---|---|---|---|
| 1,678,896 | 7/1928 | Wood . | |
| 1,738,076 | 12/1929 | Molins . | |
| 1,751,562 | 3/1930 | Stinger . | |
| 1,833,410 | 11/1931 | Chalmers . | |
| 2,037,469 | 4/1936 | Harless | 164/66 |
| 3,651,724 | 3/1972 | Huffman | 83/24 |
| 3,939,744 | 2/1976 | Junker | 83/118 |
| 4,189,965 | 2/1980 | Kollann | 83/118 |
| 4,349,140 | 9/1982 | Passafiume | 225/97 |
| 4,534,248 | 8/1985 | Andersson | 83/117 |
| 4,534,251 | 8/1985 | Wilson | 82/111 |
| 4,811,641 | 3/1989 | Muller | 83/105 |

*Primary Examiner*—Eugenia Jones
*Assistant Examiner*—Allan M. Schrock
*Attorney, Agent, or Firm*—Thomas Hooker

[57] ABSTRACT

A web cutter includes a knife roll located above an anvil roll, a web infeed conveyor for moving a continuous web to be severed to the nip between the rolls and a segment discharge conveyor for removing segments cut from the web. The roll includes a plurality of fixed cutting knives and the anvil roll includes a plurality of fixed anvils such that rotation of the rolls brings each knife into engagement with an anvil to sever the web. Lift plates on the anvil roll are located immediately upstream from each anvil to raise the severed lead end of the web above the anvil in order to assure proper feeding to the discharge conveyor.

23 Claims, 3 Drawing Sheets

TWO ROLL WEB CUTTER AND METHOD

FIELD OF THE INVENTION

The invention relates to two roll web cutters and methods for cutting segments from the lead end of a moving continuous web.

DESCRIPTION OF THE PRIOR ART

Continuous webs of fabric, paper and the like are conventionally severed by feeding the web through rotary cutting devices having a pair of continuously rotating rolls. One roll carries one or more knives and the second roll carries one or more anvils engagable with the knives. The continuous web is fed toward the rolls on a conveyor, passes between the rolls and is cut into a number of segments. The segments are conveyed away from the rolls on a second conveyor.

Two-roll web cutters are used for severing webs fed at very high speeds. While cutters of this type may be satisfactory for severing dry webs, problems are encountered in severing wet webs. This is because the web is sandwiched between the rolls during cutting and the moisture in the web adheres the lead end of the web, located immediately upstream from the severed end of the web, onto one of the rolls. Adhesion of the lead end of the web on either roll prevents the end from being fed properly downstream to the takeaway conveyor and causes jams requiring shutting down of the web cutter and associated machinery for delivering the web to the cutter and for taking away the severed web segments.

SUMMARY OF THE INVENTION

The invention is a two-roll web cutter and method for severing a continuous web which is likely to adhere to one of the rolls. Typically, the web is wet and sticks to the anvil roll as the web is moved between the rolls and is compressed against the anvil during cutting. Sticking is prevented by lifting up a plate located behind or upstream of the anvil to lift the lead end of the web off the anvil and assure feeding of the web onto a takeaway conveyor. Sticking of the web to the knife roll is prevented by providing circumferential grooves on the roll.

The web cutter may be used to sever segments from a continuous web of non-woven fabric formed of synthetic fibers saturated by a liquid. This type of web may have a number of plies and, for instance, may be made up of a plurality of stacked Z-folded plies which, after severing, form individual wet wipes. The web cutter may be operated without sticking to sever a saturated web into as many as 600 segments per minute with the segments varying from 5½ to 8½ inches in length and with the web being made up of from three or more three-layer Z-fold fabric plies. The severed segments of saturated fabric are positively fed to the takeaway conveyor for takeaway from the cutter.

In a first embodiment of the invention the lift plate is movably mounted to the anvil roll and springs bias the plate to the elevated lift position. The plate is compressed immediately before cutting. After cutting, the springs lift the plate and raise the lead end of the web for transfer to the takeaway conveyor.

In a second embodiment of the invention, the raising and lowering of the plate is controlled by a fixed cam and follower connection.

Other objects and features of the invention will become apparent as the description proceeds, especially when taken in conjunction with the accompanying drawings illustrating the invention, of which there are three sheets and two embodiments.

DESCRIPTION OF THE PREFERRED EMBODIMENT

Figure 1:
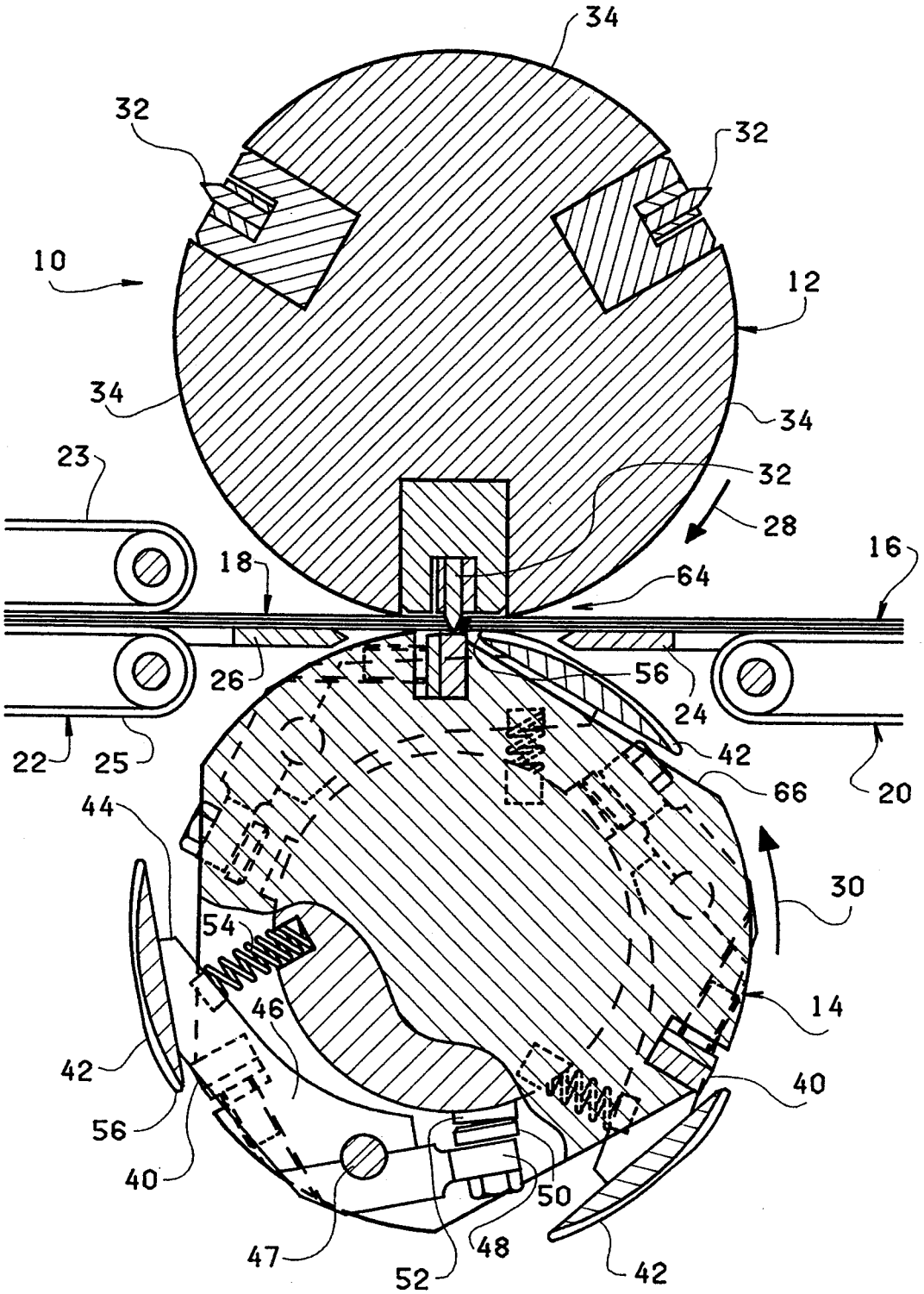
FIG. 1 is a vertical sectional view, partially broken away, of a first embodiment of the invention as the web is cut.

Web cutter 10 includes a knife roll 12 and an anvil roll 14. A continuous web 16 is severed into segments 18 by the cutter. Infeed conveyor 20 moves the web 16 to the rolls and discharge conveyor 22 removes the severed web segments from the rolls. An infeed guideplate 24 supports the movement of the web into the nip between the rolls and discharge guideplate 26 supports movement of the severed segments 18 away from the roll.

Cutter 10 includes a conventional frame for rotatably supporting the two rolls, appropriate drives for rotating the rolls in the directions of arrows 28 and 30 at the same rotary speed and at a sufficiently high speed to sever segments 18 from the web at a desired production rate. The feeds of conveyors 20 and 22 are appropriately set up to feed the web 16 to the rollers for severing at an appropriate rate and to remove the severed segments 18 at an appropriate rate. The frame and drives are conventional and are not illustrated.

Figure 5:
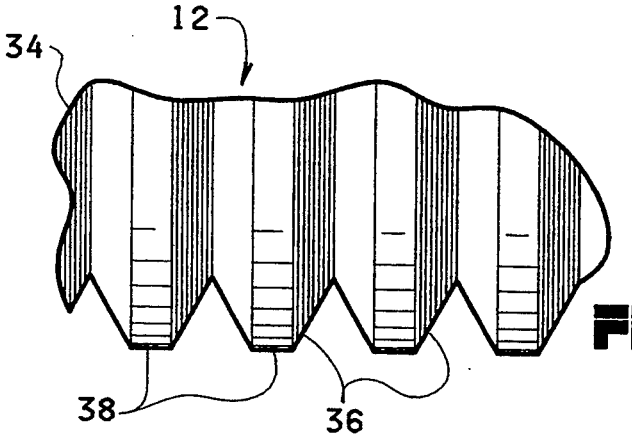
FIG. 5 illustrates the surface of the knife roll.

Knife roll 12 includes three 120 degree spaced cutting knives each extending along the width of the roll. The knives are conventionally mounted on the roll. Roll 12 includes circumferential surfaces 34 extending between the three recesses used to mount knives 32. As shown in FIG. 5, these surfaces are provided with a plurality of V-shaped circumferential grooves 36 each having a width at surface 34 greater than the width of the narrow circumferential lands 38 located between adjacent grooves. The grooves and narrow lands assure that the saturated web and cut segments do not adhere to the surface of the knife roll.

The anvil roll 14 includes three 120 degree spaced anvils 40 each extending along the width of the roll. The drive for cutter 10 rotates rolls 12 and 14 at the same speed and in proper synchronization so that each blade 32 is rotated past an anvil 40 so that the cutting edge of the blade very nearly engages the anvil and is forced through and severs the web as shown in FIG. 1. The anvils 40 are secured to anvil roll 14 by conventional mounting connections.

Figure 2:
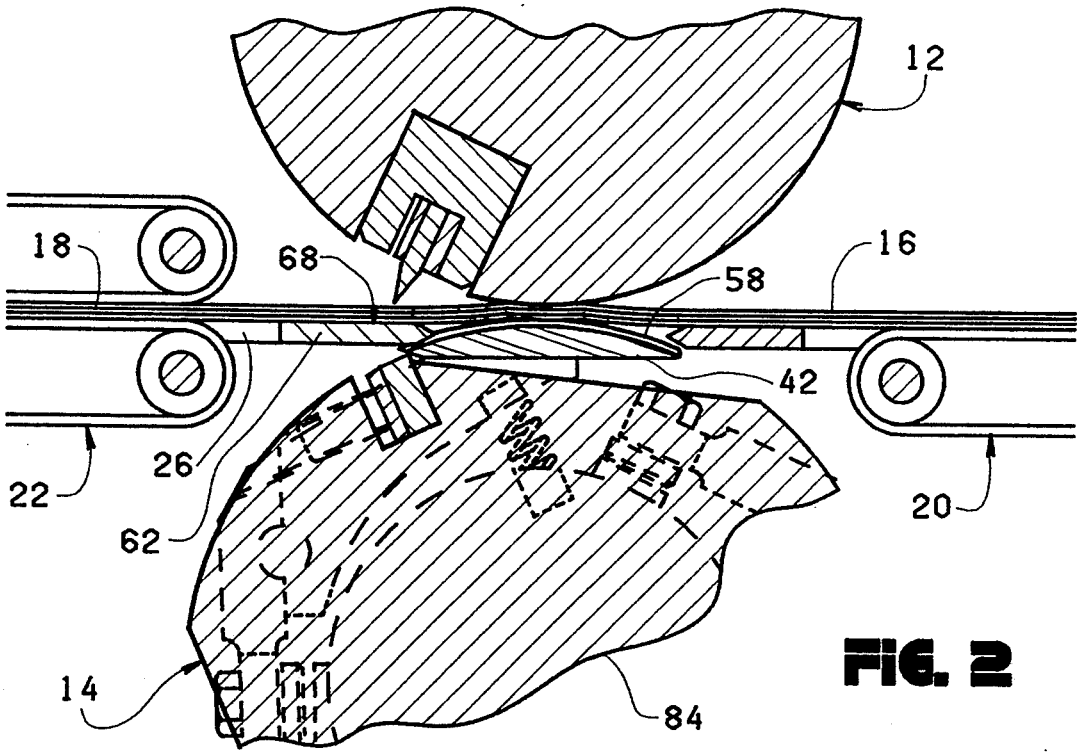
FIG. 2 is a sectional view, like FIG. 1 immediately after cutting of the web.
Figure 3:
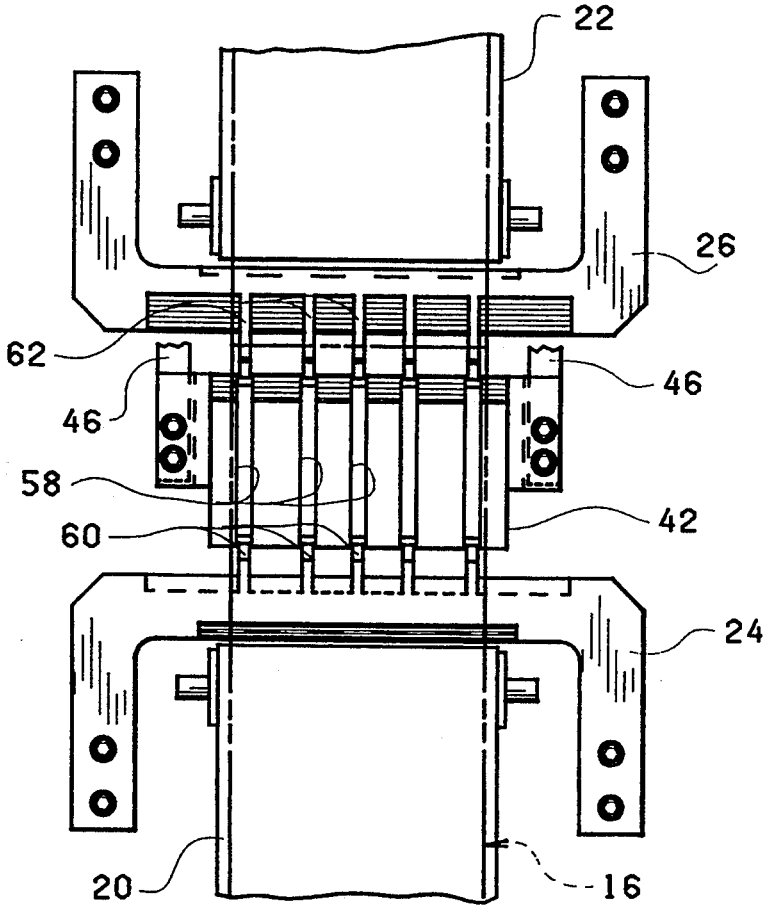
FIG. 3 is top view, partially broken away showing the infeed and takeaway conveyors and the stripping plate assembly.

The anvil roll also includes a lift plate 42 located immediately upstream of each anvil. Plates 42 are shown in FIGS. 1, 2 and 3. The plates 42 extend across and are slightly wider than the width of web 16. The ends of the plates are connected to the upstream ends 44 of a pair of pivot arms 46. The arms 46 are pivotedly mounted to pins 47 carried by roll 14. The downstream ends 48 of the arms carry adjustable stops 50 engagable with fixed stops 52 carried by the anvil roll. A spring 54 is confined between a portion of the anvil roll and the upstream end of each arm to bias lift plates 42 to the elevated position determined by engagement between stops 50 and 52 as shown in FIG. 1. When the plate is pressed inwardly to the depressed position and springs 54 are compressed, the downstream edge 56 of the plate is located adjacent and slightly above an anvil 40. When the lift plate is fully elevated by springs 54 the downstream edge 56 is moved to a position radially above and over the cutting or reaction surface of anvil 40, as illustrated by the position of the lift plates 42 located away from the knife roll 12 in FIG. 1.

A plurality of grooves 58 extend across the upper surface of each plate 42. These grooves are aligned with support fingers 60 extending downstream from the guideplate 24 and support fingers 62 extending upstream from the guideplate 26. The fingers 60, 62 are narrower than grooves 58 to prevent engagement between the fingers and the plate when the plate is elevated as shown in FIG. 2.

The operation of web cutter 10 will now be described.

Rolls 12 and 14 are rotated at a synchronous rate in the directions of arrows 28 and 30 and conveyors 20 and 22 are actuated to feed the web 16 through the nip 64 between the rolls and move the severed segments 18 away from the nip. Each associated blade 32 and anvil 40 is rotated into the nip between the rolls. The web 16 extends between the anvil and blade. As the two rolls rotate to the cutting position of FIG. 1 the anvil and fully raised lift plate 42 move toward the nip 64. The anvil and blade move into the nip to sever the web as shown in FIG. 1 and the lead or downstream edge 56 of the lift plate engages the lower surface of the web and holds the web against the adjacent edge of roll 12. The web is sandwiched between the roll and the plate and depresses the plate, compresses springs 54 and lowers the plate into flat or recess 66 formed in roll 14 as shown in FIG. 1. Lowering of the lift plate moves the lead edge 56 to a position immediately adjacent the side of the anvil so that the web and plate are free of blade 32 as it rotates into near engagement with the anvil and severs the web. See FIG. 1.

FIG. 2 illustrates the position of the rolls shortly after severing where the cut 68 formed in FIG. 1 has moved downstream and is positioned on fingers 62 of the discharge guideplate 26. During rotation of the rolls from the position of FIG. 1 to the position of FIG. 2, the plate 42 is elevated upwardly by springs 54 to hold the overlying web against the side of the knife roll 12. In this way, the lead end of web 16 at cut 68 is positively elevated above the surface of the anvil roll 14 and fed downstream onto the discharge conveyor 22. The ends of fingers 62 fit in the grooves 58 in plate 42 during movement of the lead end of the web, thereby assuring that the lead end of the web which forms the next successive segment to be severed from the web is properly fed into the discharge conveyor 22. The discharge conveyor 22 includes upper and lower belts 23 and 25 to assure engagement with and downstream movement of segments 18. Continued rotation of the two rolls moves the plate out of engagement with the web and knife roll thereby allowing springs 54 to return the plate to the fully elevated position as shown on the left hand side of FIG. 1.

Web 16 may include a number of plies of a non woven synthetic plastic folded sheet material saturated with a sticky liquid. The wet, sticky web easily adheres to the anvil and knife rollers. During cutting the knife presses the web tightly against the flat cutting surface of the anvil forming an adhesion joint between the anvil and the web. The lift plate 42 moves the leading edge of the web upstream of the cut 68 away from the anvil to break the connection and, with fingers 62 fitted in groove 68, assures that the leading end of the web is moved onto plate 26 and to the discharge conveyor 22. The V-shaped grooves 36 formed in surfaces 34 on the knife roll prevent the top of the web from sticking to the knife roll despite the fact that the web is held against the roll by plate 42 during a short interval after cutting. The narrow lands 38 are not sufficiently wide to form large area wet connections with the web.

The ready adhesion of the wet, sticky web to the rolls is a significant problem at high production rates where the web may be traveling at a rate of more than 400 feet per minute and the cutter may be severing as many as 600 segments from the web per minute. The stripping plates and grooves in the knife roller assures proper feeding of the wet, sticky web at these high production rates.

Figure 4:
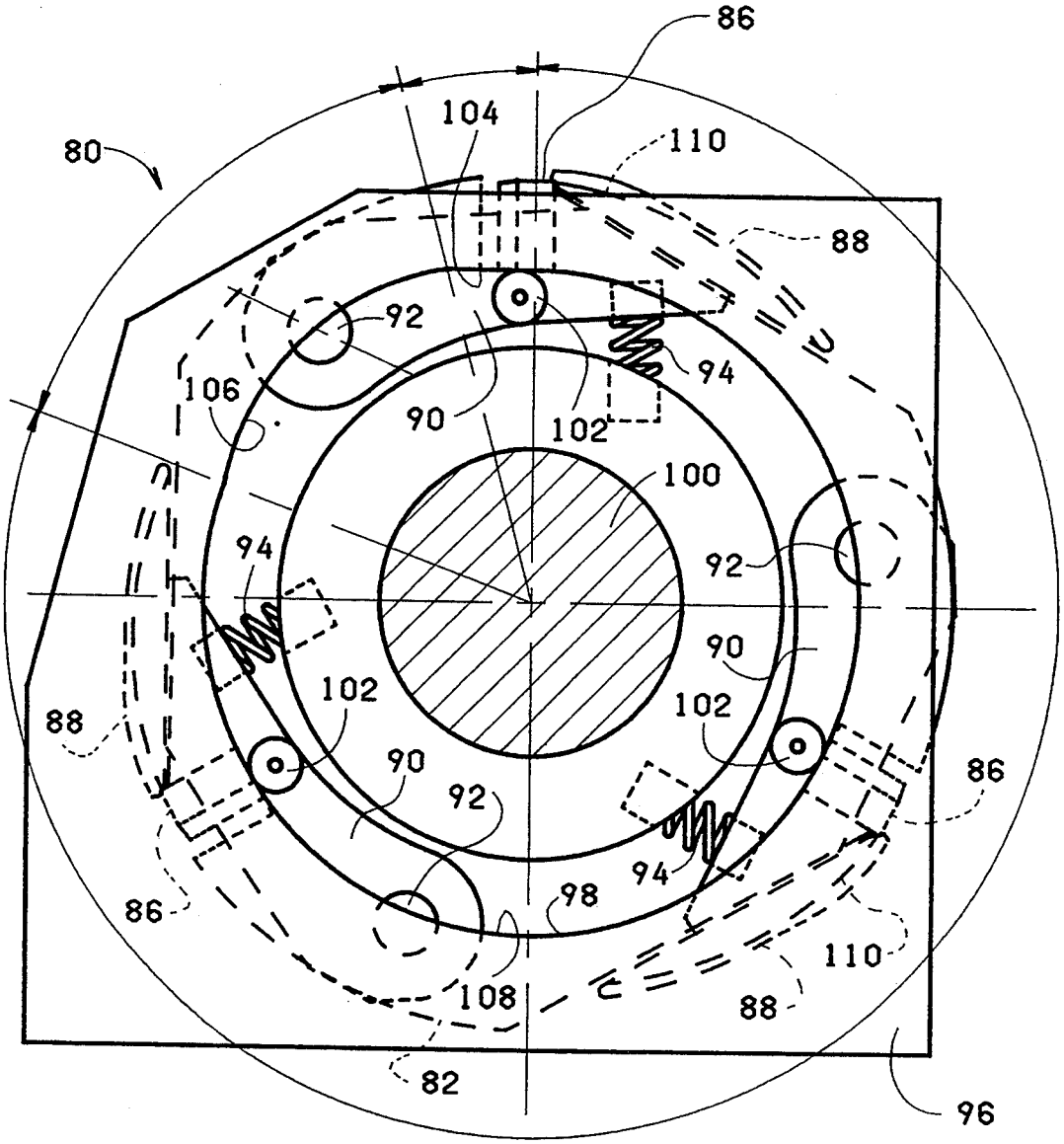
FIG. 4 is a sectional view of the second embodiment of the cutting apparatus.

FIG. 4 illustrates the sectional view taken through one end of an anvil roll 80 of a second embodiment of the invention. Roll 80 is like roll 14 but includes a cam drive for controlling the elevation and retraction of the lift plates. The roll 80 may replace roll 14 in a web cutter to sever lead segments 18 from web 16 as described in connection with the operation of the first embodiment. Only anvil roll 80 is shown in FIG. 4.

Roll 80 includes a body 82 essentially identical to body 84 of roll 14. Three anvils 86, like anvils 40, are equally spaced around the circumference of the body 82. Roll 80 also includes three lift plates 88, like plates 42, located on the upstream sides of the anvils 86. Each plate 88 is connected to the body by a pair of pivot arms 90 similar to arms 46 which rotate on pins 92 mounted on body 82. Unlike arms 46, arms 90 do not include downstream ends or adjustable stops. Springs 94, like springs 54, are confined between the body and the ends of the arms 90 adjacent lift plates 88 to bias the arms and lift plates toward elevated positions.

Fixed cam plate 96 is secured to the frame of the web cutter 10 by an appropriate connection (not illustrated) and includes a central aperture 98 surrounding reduced diameter shaft 100 on the end of the body. The shaft extends are journalled in a bearing on the cutter frame. The springs 94 bias the arms 90 radially outwardly to hold cam follower rollers 102 on the arms against the surface of aperture 98. Aperture 98 defines a cam surface having a sharp rise surface 104, a gradual fall surface 106 and dwell surface 108. Rotation of roll 80 moves each roller 102 around the cam surface to elevate and retract the corresponding lift plate 88 through a cycle like the cycle of plates 42 in cutter 10. The movement of plates 88 between the retracted and elevated positions is preferably controlled by a single cam plate engaging rollers on arms 90 at one end of the anvil roll.

As the plate 88 is rotated up toward the nip of the web cutter, the roller 102 is moved along the dwell surface 108 and the plate 88 is held in the retracted position as illustrated. Immediately before the adjacent anvil 86 is moved into the nip at the 12:00 position, the roller 102 is moved from the dwell surface onto the rapid rise surface 104 and springs 94 begin to move the lift plate 88 to the elevated position to move the severed lead end of the web upwardly, move the grooves 110 on the plate around the fingers 62 of the discharge guideplate and assure that the new severed lead end of the web is fed along the guideplate and into the discharge conveyor. Initial upward movement of plate 88 occurs immediately prior to severing the web in order to assure that the plate is moved upward in time for proper feeding of the web without interfering with cutting the web. After the lead end of the web has been fed onto the discharge guideplate, roller 102 is moved to the fall surface 106 and the plate is returned to the retracted position as illustrated.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention is:

1. A web cutter including a knife roll having a cutting knife, an anvil roll including a rotary the body, a lift plate on the body upstream from the anvil, a plurality of grooves extending across a top of the lift plate in the direction of rotation, and lifting means for moving the plate from a retracted position located to one side of the anvil to an elevated position located radially above the anvil, the anvil roll being located adjacent the knife roll to define a nip between the rolls, a drive for rotating the knife roll and the anvil roll and moving the knife and anvil downstream so that said knife and anvil come into engagement at the nip to sever a web extending between the rolls, and a discharge guideplate located adjacent and immediately downstream from the nip, said guideplate including a plurality of fingers extending toward the nip and into said grooves as the elevated lift plate is rotated past the guideplate.

2. A web cutter as in claim 1 including an infeed guideplate located immediately upstream from the nip and, such guideplate including a plurality of fingers extending toward the nip.

3. A web cutter as in claim 1 wherein said lifting means includes an arm joining the lift plate and extending in a downstream direction therefrom to an end, a pivot connection joining the end of the arm to the anvil roll and a spring biasing the lift plate outwardly of the anvil roll.

4. A web cutter as in claim 3 wherein said lifting means includes a cam follower on the arm, a stationary cam plate surrounding the anvil roll, an aperture in the cam plate defining a continuous cam surface having a steep rise segment located to allow outward pivotal movement of the arm as the lift plate moves through the nip and a gradual fall segment, said spring biasing said follower against said cam surface.

5. A method of severing a lead end of a continuously moving sticky web into a plurality of web segments comprising the steps of:

a) moving a web through a nip between rotating anvil and knife rolls of a web cutter to cut successive segments from an end of the web and adhere ends of the segments and each successive lead end of web to the anvil roll;

b) breaking each segment away from the anvil roll and moving each segment away from the nip;

c) moving a plate on the anvil roll radially above the anvil roll immediately after forming each cut to strip each successive lead end of the web from the anvil roll and thereby lift each such end above the anvil roll;

d) moving a lead edge of the plate on the anvil roll adjacent to a guideplate located downstream from the nip to define a web support surface extending away from the nip; and e) moving each of said elevated lead ends of the web along such surface and away from the web cutter.

6. The method of claim 5 including the steps of engaging and positively feeding the lead end of the web away from the web cutter.

7. The method of claim 5 including the steps of moving the leading edge of the elevated plate past the guideplate during movement of the lead end of the web along the surface.

8. The method of claim 7 wherein the anvil roll includes an anvil and including the step of moving the lead edge of the plate on the anvil roll over the anvil immediately after forming each cut.

9. The method of claim 8 including the step of feeding the web along a conveyor to the web cutter and removing each web segment along a second conveyor from the web cutter.

10. A web cutter for severing segments from a lead end of a continuous web fed downstream through the cutter, the cutter comprising:

a) a knife roll including a cutting knife;

b) an anvil roll located adjacent the knife roll to define a nip between the rolls, an anvil on the anvil roll cooperable with the knife to sever a web extending through the nip between the rolls;

c) a drive for rotating the rolls to bring the knife and anvil together at the nip and sever a web;

d) a discharge guideplate located between the rolls downstream from the nip;

e) a lift plate mounted on the anvil roll upstream from the anvil, the lift plate having a downstream edge, said plate being movable between a depressed position where said edge is located immediately upstream of the anvil and an elevated position where said edge is located radially above the anvil and immediately adjacent the discharge guideplate; and f) first means for locating the lift plate in the depressed position when the anvil is moved through the nip and the knife and anvil sever a web and for moving the lift plate from the depressed position to the elevated position immediately after the anvil is moved through the nip thereby stripping a newly severed lead end of a web from the anvil.

11. A web cutter as in claim 10 including interengagement means for forming a sliding connection between the downstream edge of the lift plate and the guideplate.

12. A web cutter as in claim 11 including an infeed guideplate located adjacent to and upstream from the nip.

13. A web cutter as in claim 12 including a web infeed conveyor located upstream of the infeed guideplate and a web segment discharge conveyor located downstream of the discharge guideplate.

14. A web cutter as in claim 13 wherein said discharge conveyor includes means for engaging and moving a web segment away from the nip.

15. A web cutter as in claim 11 wherein said interengagement means includes a finger and groove connection between the discharge guideplate and the lift plate.

16. A web cutter as in claim 15 including a plurality of fingers on the discharge guideplate and a plurality of grooves extending across the lift plate in the direction of rotation of the anvil roll, said fingers fitting freely in said grooves when the lift plate is in the elevated position and rotated away from the nip.

17. A web cutter as in claim 10 wherein said first means includes an elongate arm having one end pivotedly mounted on the anvil roll and another end joined to the lift plate and a spring biasing the lift plate outwardly of the anvil roll.

18. A web cutter as in claim 17 including a cam follower on the arm, and a fixed cam plate including an interior opening surrounding the anvil roll and defining a continuous cam surface having a rise section engagable by the roller when the lift plate is moved through the nip and a fall surface, said spring biasing said roller against said cam surface.

19. A web cutter as in claim 17 wherein the anvil is located between the ends of the arm.

20. A web cutter as in claim 10 including a plurality of grooves extending across the upper surface of the lift plate.

21. A web cutter as in claim 20 including a plurality of fingers on the discharge guideplate, said fingers extending into said grooves when the lift plate is in the elevated position adjacent the discharge guideplate.

22. A web cutter as in claim 21 including a plurality of circumferential grooves extending around the knife roll.

23. A web cutter as in claim 22 including lands located on the knife roll between each of the circumferential grooves, said grooves having a width greater than the width of the lands.

* * * * *

UNITED STATES PATENT AND TRADEMARK OFFICE

CERTIFICATE OF CORRECTION

PATENT NO. : 5,363,728

DATED : NOVEMBER 15, 1994

INVENTOR(S) : BERTRAM F. ELSNER

It is certified that error appears in the above-identified patent and that said Letters Patent is hereby corrected as shown below:

Column 5, line 20, after "rotary", insert --body, an anvil on--.

Signed and Sealed this

Fourteenth Day of February, 1995

*Attest:*

*Attesting Officer*

BRUCE LEHMAN

*Commissioner of Patents and Trademarks*